US007641444B1

(12) United States Patent
Liang

(10) Patent No.: US 7,641,444 B1
(45) Date of Patent: Jan. 5, 2010

(54) SERPENTINE FLOW CIRCUIT WITH TIP SECTION COOLING CHANNELS

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 557 days.

(21) Appl. No.: 11/654,151

(22) Filed: Jan. 17, 2007

(51) Int. Cl.
*F01D 5/18* (2006.01)

(52) U.S. Cl. ..... 416/1; 416/90 R; 416/92; 416/97 R

(58) Field of Classification Search ..... 415/1, 415/115, 116; 416/1, 90 R, 92, 96 R, 96 A, 416/97 R See application file for complete search history.

(56) References Cited

U.S. PATENT DOCUMENTS 4,278,400 A * 7/1981 Yamarik et al. ..... 416/97 R
4,474,532 A 10/1984 Pazder
4,753,575 A 6/1988 Levengood et al.
5,271,715 A * 12/1993 Zelesky et al. ..... 416/97 R
5,403,159 A 4/1995 Green et al.
5,462,405 A 10/1995 Hoff et al.
5,733,102 A 3/1998 Lee et al.
5,813,836 A 9/1998 Starkweather
6,164,914 A 12/2000 Correia et al.
6,190,129 B1 * 2/2001 Mayer et al. ..... 416/97 R
6,431,832 B1 8/2002 Glezer et al.
6,971,851 B2 12/2005 Liang
7,097,419 B2 8/2006 Lee et al.
7,104,757 B2 9/2006 Gross
2004/0151587 A1 * 8/2004 Cunha et al. ..... 416/97 R

* cited by examiner

*Primary Examiner*—Christopher Verdier
(74) *Attorney, Agent, or Firm*—John Ryznic

(57) ABSTRACT

A turbine blade having a three pass forward flowing serpentine flow cooling circuit with a first leg connected to exit cooling holes along the trailing edge of the blade, a third and last leg discharging cooling air from the serpentine flow circuit through pressure and suction side film cooling holes, and two blade tip peripheral cooling channels extending along the pressure side and the suction side of the blade tip to provide cooling. Each peripheral channel includes film cooling holes on the blade tip side walls and exit cooling holes on the tip cap. All of the cooling air from the first leg channel that does exit out the trailing edge holes flows into the last leg without discharging through holes in the blade tip. All of the cooling air flowing out the peripheral channel cooling holes flows out from the last leg of the serpentine flow circuit.

16 Claims, 5 Drawing Sheets

SERPENTINE FLOW CIRCUIT WITH TIP SECTION COOLING CHANNELS

BACKGROUND OF THE INVENTION

1. Field of the Invention

The present invention relates generally to fluid reaction surfaces and more specifically to a turbine blade with blade tip cooling.

2. Description of the Related Art Including Information Disclosed Under 37 CFR 1.97 and 1.98

Rotor blades used in a gas turbine engine generally include internal cooling air passages to provide required cooling of the blade, especially in the first and second stages. The rotor blades also include seals between the blade tip and an outer shroud of the casing in order to limit the hot gas flow leakage across the resulting gap. A squealer tip is one typical seal in which the blade tip includes a squealer tip rail extending around the blade walls and forming a squealer pocket. Hot gas flow into the pocket and across the gap can also produce damage or reduce the life of a blade. Thus, the blade tip and squealer pockets also require cooling air flow.

One prior art design for cooling the blade tip is shown in FIG. 1. The blade includes a mid-chord serpentine flow cooling circuit which is known as a 1+3 serpentine flow cooling circuit to provide internal cooling for the blade and the leading edge region. The airfoil leading edge is cooled with a backside impingement cooling along with leading edge showerhead film cooling holes and pressure side and suction side gill holes. The cooling air for the leading edge cooling is supplied through a separate radial supply channel. The airfoil main body is cooled with the triple pass forward flowing serpentine cooling circuit that also includes pressure side and suction side film cooling holes and trailing edge discharge cooling holes.

In the cited prior art references, blade tip cooling is accomplished by drilling holes into the upper extremes of the serpentine flow cooling circuit passages from both the pressure and suction surfaces near the blade tip edge and the top surface of the squealer cavity or pocket. Film cooling holes are built-in along the airfoil pressure side and suction side tip sections from leading edge to trailing edge to provide edge cooling for the blade squealer tip. Also, convective cooling holes also built-in along the tip rail at the inner portion of the squealer pocket provide additional cooling for the squealer tip rail. Since the blade tip region is subject to severe secondary flow field, this results in a large quantity of film cooling holes and cooling flow required for cooling the blade tip periphery. FIGS. 2 and 3 show a profile view of the pressure side and the suction side tip peripheral cooling holes for this prior art blade tip cooling design.

For the prior art cooling circuit of FIG. 1, the last leg of the serpentine flow cooling circuit geometry is predetermined by the manufacturing requirement. As a result of the cooling design requirement when the cooling air is bled off from the cavity for the cooling of both pressure and suction side walls as well as the blade tip section, the spanwise internal Mach number for the cooling air flow through the last leg becomes lower. This translates to a lower through-flow velocity and cooling side internal heat transfer coefficient. In other words, the pressurized cooling air delivered into the first leg of the serpentine flow circuit discharges a portion of the cooling through a plurality of trailing edge exit holes, with the remaining cooling air flowing through the blade tip channel where more cooling air is diverted through the blade tip exit holes. Even less cooling air remains to flow down the second leg of the serpentine flow circuit before flowing up the last leg, where more cooling air is diverted out through the film cooling holes on both the pressure side and suction side. After all this cooling air is diverted from the main serpentine circuit, not enough cooling air is left to maintain the high flow rate (Mach number) to provide the necessary cooling to the blade and tip. This lower internal Mach number and low cooling side internal heat transfer coefficient can be eliminated by the use of the serpentine flow and blade tip cooling circuit of the present invention.

The Prior Art reference U.S. Pat. No. 4,753,575 issued to Levengood et al on Jun. 28, 1988 and entitled AIRFOILS WITH NESTED COOLING CHANNELS shows a turbine blade with an internal cooling circuit having a forward flowing serpentine cooling circuit and a leading edge cooling channel that turns at the blade tip and flows into a chordwise extending channel portion (#54 in this patent), the tip channel discharging cooling air through tip holes 59. In the Levengood patent, the serpentine flow circuit does not discharge cooling air to the blade tip as does the circuit of the present invention.

Another Prior Art reference, U.S. Pat. No. 5,403,159 issued to Green et al on Apr. 4, 1995 and entitled COOLABLE AIRFOIL STRUCTURE, shows a turbine blade with an internal cooling circuit having a forward flowing serpentine cooling circuit in which the third and last leg (#92 in this patent) discharges into a blade tip passage (#74 in this patent) with cooling air holes discharging cooling air from the tip passage to the sides and top of the blade tip section. In the Green patent, the cooling air in the serpentine circuit is not discharged onto the tip before flowing through the last leg as in the present invention. However, the first or second legs of the serpentine circuit do not run along the blade tip cap such that the serpentine flow cooling air in the serpentine circuit can be used to cool the blade tip cap as in the present invention.

It is an object of the present invention to provide cooling for a blade tip of a turbine blade without diverting too much cooling air from the internal cooling passages so that proper internal cooling of the blade is still accomplished.

Another object of the present invention is to reduce the cooling air flow requirement while providing adequate blade cooling for a turbine blade.

Still, another object of the present invention is to allow for the first or second legs of the serpentine flow cooling circuit to provide cooling to the blade tip cap without discharging cooling air from the serpentine circuit through the tip cap.

Another object of the present invention is to provide for individual blade tip cooling flow circuit on the pressure side and on the suction side that can be selectively sized for cooling flow.

BRIEF SUMMARY OF THE INVENTION

The present invention is a turbine blade with a serpentine flow cooling circuit to provide internal cooling for the blade, and where the cooling air used to pass through blade tip cooling holes passes through the entire serpentine flow circuit before discharging through the tip cooling holes. A pressure side peripheral cooling channel and a suction side peripheral cooling channel are both connected to the last leg of the serpentine flow circuit and channel cooling air from the serpentine flow circuit along the blade tip to be discharged through tip exit holes connected to these peripheral channels. In this design, the cooling air passing through the tip exit holes passes through all three legs of the serpentine flow circuit before being discharged out the tip holes. Therefore, the proper Mach number is maintained in the last leg of the serpentine flow circuit in order to provide the designed for internal blade cooling in the last leg.

DETAILED DESCRIPTION OF THE INVENTION

Figure 5:
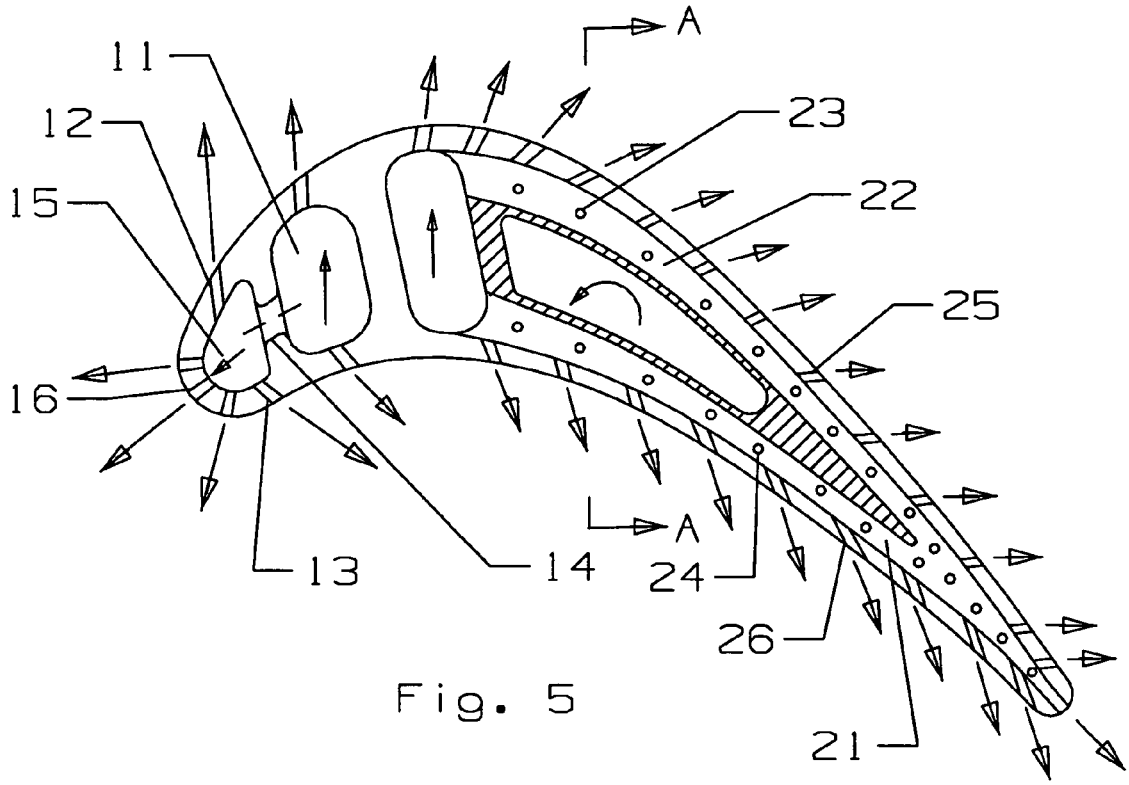
FIG. 5 shows a top view for the cooling circuit of the present invention.
Figure 6:
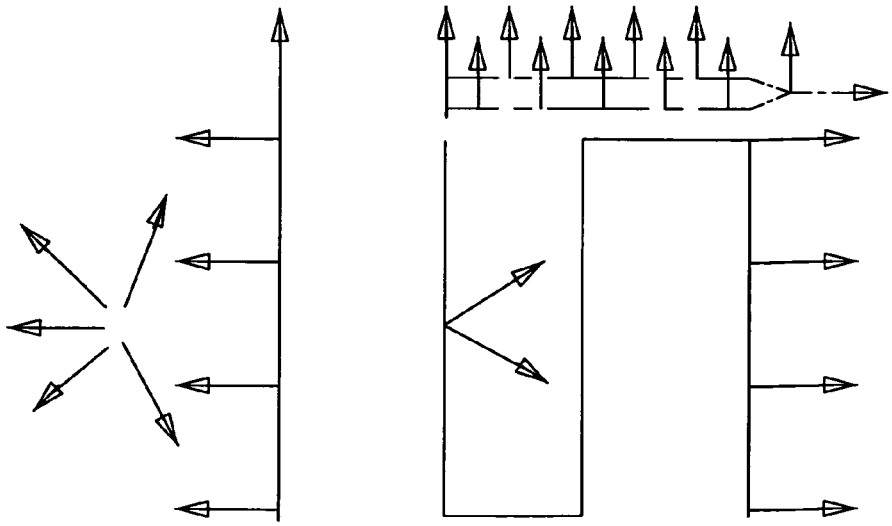
FIG. 6 shows a schematic view of the cooling circuit of the present invention of FIG. 5.

The present invention is a turbine blade with a blade tip cooling circuit that includes peripheral channels along both the pressure side and suction side of the blade tip. The turbine blade is shown in FIG. 5 with a top view of a cross section of the blade taken along the blade tip. The blade includes a leading edge cooling supply channel 11 to supply cooling air from an external source to cool the leading edge region. Film cooling holes on the pressure side and the suction side of the blade discharge cooling air from the leading edge supply channel 11. A metering hole 14 meters cooling air into a leading edge cooling cavity 15, which then discharges cooling air through suction side gill holes 12, pressure side gill holes 13 and showerhead film cooling holes 16.

Figure 1:
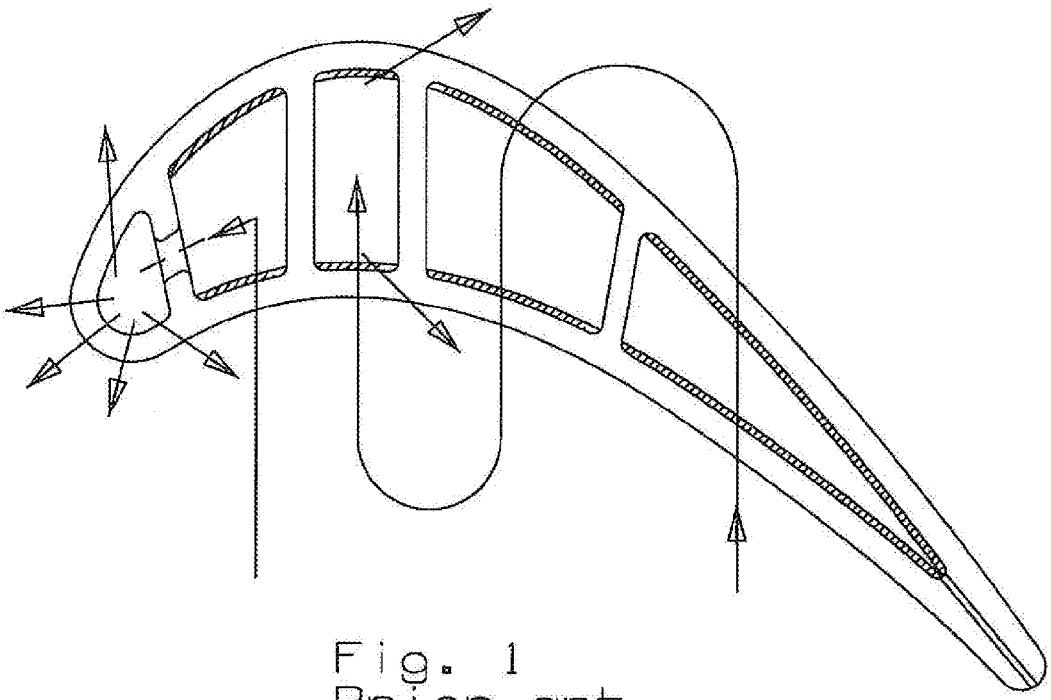
Fig. 1 Prior art
FIG. 1 shows a top view of a internal cooling circuit for a turbine blade of the prior art.
Figure 2:
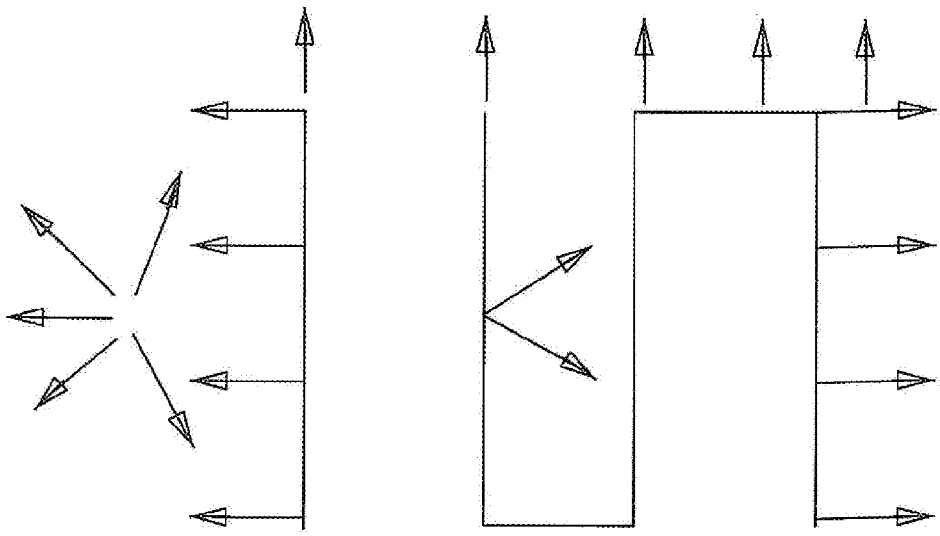
Fig. 2 Prior Art
FIG. 2 shows a schematic view of the internal cooling passages of the prior art FIG. 1 turbine blade.
Figure 3:
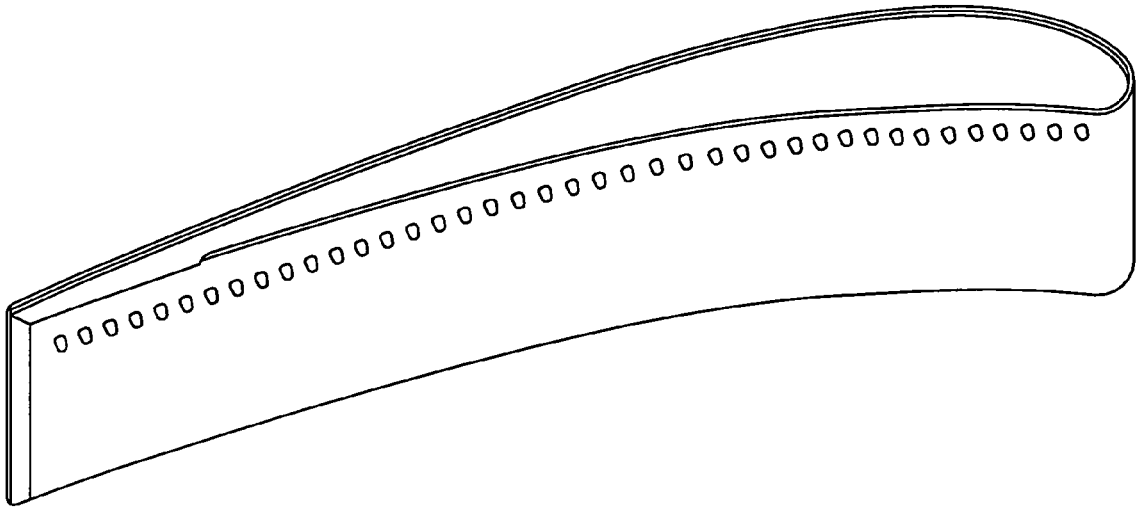
Fig. 3 Prior art
FIG. 3 shows a pressure side tip cooling hole arrangement for a prior art turbine blade.
Figure 4:
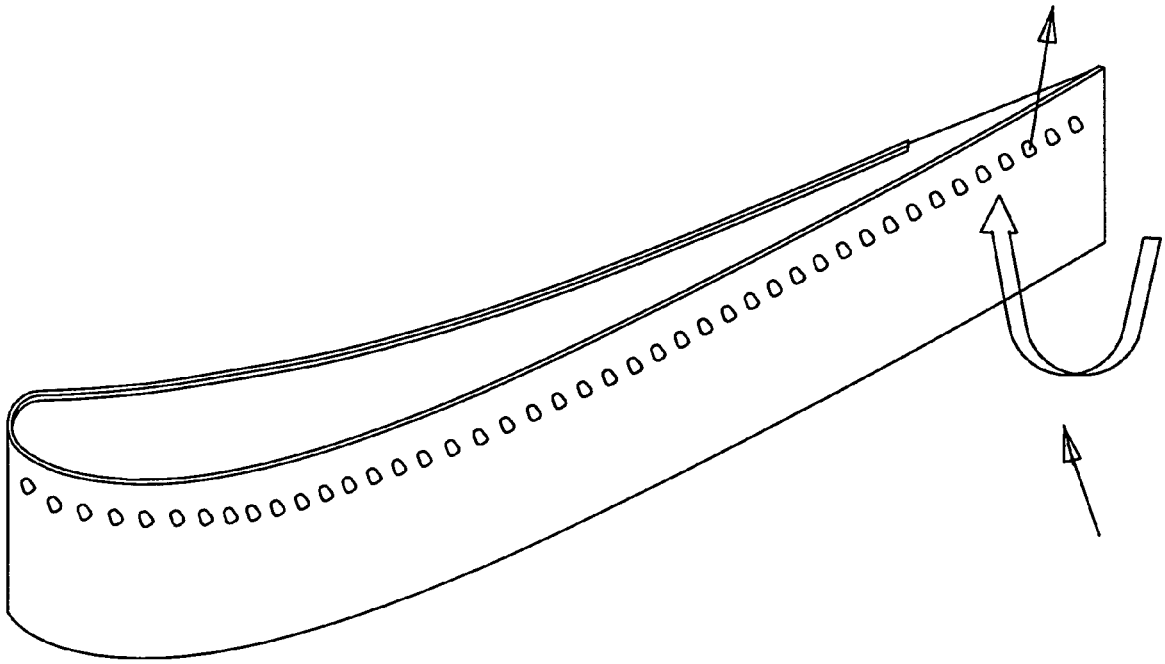
Fig. 4 Prior art
FIG. 4 shows a suction side tip cooling hole arrangement for a prior art turbine blade.
Figure 7:
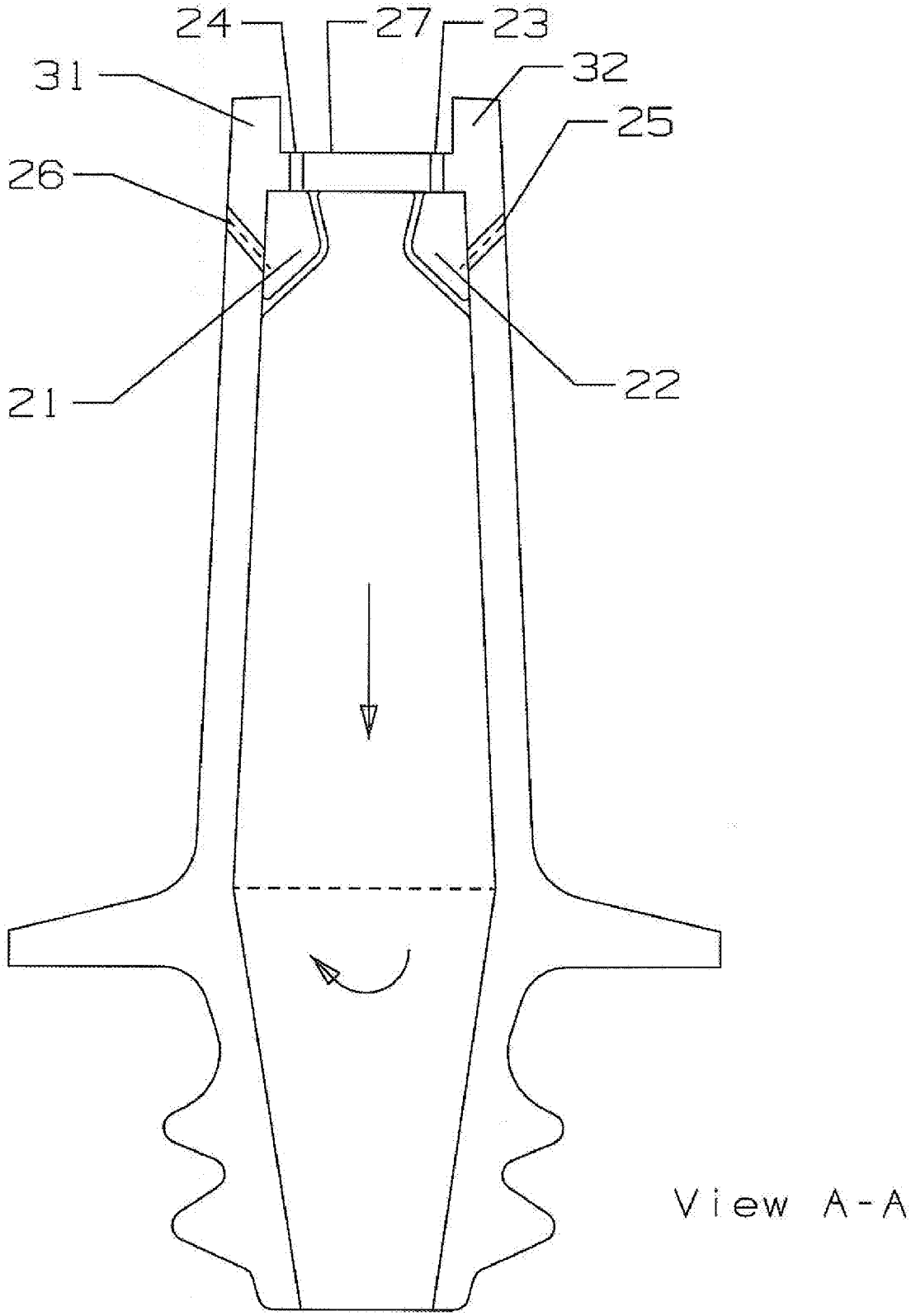
FIG. 7 shows a side view of a cross section of the turbine blade cooling circuit of the present invention.

The mid-chord and trailing edge region of the blade is cooling by a three pass serpentine flow cooling circuit as shown in FIG. 1 except that no blade tip exit cooling holes are connected to the serpentine flow circuit as in the FIG. 1 prior art turbine blade. Exit holes along the trailing edge are connected to the first leg of the serpentine flow circuit as in the prior art FIG. 1 design. Film cooling holes on the pressure side and the suction side are connected to the last leg of the serpentine flow circuit as in the prior art FIG. 1 design. The present invention includes a pressure side peripheral cooling channel 21 and a suction side peripheral cooling channel 22 both extending from the end of the last leg of the serpentine flow circuit and joining together along the trailing edge region of the blade as seen in FIG. 5. Blade tip convection cooling holes 23 and 24 open onto the top of the tip cap 27 and are connected to the peripheral channel. Tip film cooling holes 25 on the suction side and tip film cooling holes 26 on the pressure side are connected to the peripheral channels and discharge cooling air out to the sides of the blade tip on the pressure and suctions ides as seen in FIG. 7. The tip cap 27 forms an upper surface of the serpentine flow channel in which the first leg flows into the second leg of the serpentine flow circuit such that the cooling air flowing in the turn functions to provide cooling for the tip cap 27. The blade tip includes a pressure side tip rail 31 and a suction side tip rail 32.

Instead of using bleed-off cooling air from each of the legs of the serpentine flow cooling circuit of the prior art to provide tip section cooling, the present invention makes use of two separate tip section cooling flow channels built-in at the end of the third or last leg of the serpentine flow cooling circuit. The third or last leg of the serpentine flow channel is constructed with a pressure side tip peripheral cooling flow channel and a suction side tip peripheral cooling flow channel.

In operation, the majority of the tip section cooling has not been discharged from the blade serpentine flow channel when it reaches the end of the last leg of the serpentine flow channel. As a result of the cooling flow circuit of the present invention, the majority of the tip cooling air is channeled through the serpentine flow channels to enhance the serpentine flow channel internal through flow Mach number. This results in a higher channel internal heat transfer coefficient and greatly increases the serpentine flow channel internal cooling performance. After the cooling air passes through the serpentine flow channels, the tip section cooling air is then channeled through the blade tip peripheral channel along the blade tip rail. Tip section film cooling holes as well as convective cooling holes are drilled into the tip section peripheral cooling channel, at compound angled orientation, to provide blade tip section cooling. Since the tip section peripheral cooling channel is running parallel with the blade squealer tip rail, it provides additional backside convective cooling for the blade tip rail, especially for the off-set tip rail design application. The present invention therefore provides for an effective method for the cooling of blade tip rails which reduces the blade tip rail metal temperature.

The process for cooling the turbine blade of the present invention includes the following steps: passing cooling air through a trailing edge channel forming a first leg of a three pass serpentine flow cooling circuit and diverting a portion of the cooling air through the trailing edge cooling holes; passing the cooling air through a second leg without discharging any of the cooling air through cooling holes in the tip; passing the cooling air through the third leg and discharging a portion of the cooling air through the pressure and suction side film cooling holes; passing the cooling air from the third leg through peripheral channels arranged along the pressure and suction sides of the tip to provide cooling for the blade tip; and, discharging the cooling air from the peripheral channels out through cooling holes positioned around the blade tip. Additional steps include: cooling the tip cap with the cooling air flowing from the first leg into the second leg of the serpentine flow circuit by convection; and, merging the cooling air in the two peripheral channels in the trailing edge region of the blade and discharging the remaining cooling air through an exit hole in the trailing edge of the blade; and, cooling the leading edge region of the blade with a separate supply of cooling air through a cooling impingement cavity and a showerhead.

I claim the following:

1. A turbine blade for use in a gas turbine engine, the blade comprising:

a serpentine flowing cooling circuit including a first leg extending along a trailing edge region of the blade, the first leg being a cooling air supply leg for the serpentine flow circuit;

a plurality of exit cooling holes arranged along the trailing edge region of the blade and connected to the first leg of the serpentine flow circuit;

a pressure side peripheral cooling channel extending along a blade tip and in fluid communication with a last leg of the serpentine flow circuit;

a suction side peripheral cooling channel extending along a blade tip and in fluid communication with the last leg of the serpentine flow circuit;

a plurality of pressure side tip film cooling holes connected to the pressure side peripheral cooling channel; and, a plurality of suction side tip film cooling holes connected to the suction side peripheral cooling channel.

2. The turbine blade of claim 1, and further comprising:

the pressure side peripheral channel and the suction side peripheral channel are separated by a turn channel between the first leg and a second leg of the serpentine flow circuit, and a tip cap forms a wall of the turn channel such that the serpentine flow cooling air in the turn channel functions to cool the tip cap.

3. The turbine blade of claim 2, and further comprising:

the pressure side peripheral channel and the suction side peripheral channel merge in the trailing edge region of the blade; and, the merged peripheral channel is connected to a trailing edge exit hole.

4. The turbine blade of claim 1, and further comprising:

the two peripheral channels both include a plurality of tip exit cooling holes to discharge cooling air into a squealer pocket.

5. The turbine blade of claim 1, and further comprising:

the last leg of the serpentine flow circuit is a third leg of a three pass serpentine flow circuit and includes a row of pressure side film cooling holes and a row of suction side film cooling holes.

6. The turbine blade of claim 1, and further comprising:

a leading edge cooling supply channel in fluid communication with a source of pressurized cooling air; and, a showerhead in fluid communication with the leading edge cooling supply channel to discharge cooling air onto the leading edge of the blade.

7. The turbine blade of claim 3, and further comprising:

all of the cooling air flowing out through the tip film holes and the merged peripheral channel exit hole passes out from the last leg of the serpentine flow circuit.

8. A process for cooling a turbine blade, the turbine blade having a leading edge with a showerhead, a trailing edge with a plurality of exit cooling holes, a pressure side with a row of film cooling holes, and a suction side with a row of film cooling holes, the blade including a squealer tip with a pocket formed by a tip rail and a tip cap, the process comprising the steps of:

passing cooling air through a trailing edge channel forming a first leg of a three pass serpentine flow cooling circuit and diverting a portion of the cooling air through the trailing edge cooling holes;

passing the cooling air through a second leg without discharging any of the cooling air through cooling holes in the tip;

passing the cooling air through the third leg and discharging a portion of the cooling air through the pressure and suction side film cooling holes;

passing the cooling air from the third leg through peripheral channels arranged along the pressure and suction sides of the tip to provide cooling for the blade tip; and, discharging the cooling air from the peripheral channels out through cooling holes positioned around the blade tip.

9. The process for cooling the turbine blade of claim 8, and further comprising the step of:

cooling the tip cap with the cooling air flowing from the first leg into the second leg of the serpentine flow circuit by convection.

10. The process for cooling the turbine blade of claim 8, and further comprising the step of:

merging the cooling air in the two peripheral channels in a trailing edge region of the blade and discharging the remaining cooling air through an exit hole in the trailing edge of the blade.

11. The process for cooling the turbine blade of claim 9, and further comprising the step of:

cooling a leading edge region of the blade with a separate supply of cooling air through a cooling impingement cavity and the showerhead.

12. A squealer tip for a turbine blade comprising:

a tip rail forming the squealer tip with a tip cap, the tip rail and the tip cap forming a squealer pocket;

a pressure side peripheral cooling channel extending along a portion of the tip on the pressure side;

a suction side peripheral cooling channel extending along a portion of the tip on the suction side;

an internal blade cooling circuit formed partially by the tip cap separating the two peripheral channels;

an internal cooling supply channel in communication to both of the peripheral cooling channels to supply cooling air to the peripheral channels; and, the two peripheral channels merge in a trailing edge portion of the tip.

13. The squealer tip of claim 12, and further comprising:

a plurality of film cooling holes connected to the two peripheral channels to supply film cooling air to the pressure and suction sides of the squealer tip.

14. The squealer tip of claim 13, and further comprising:

a plurality of pocket exit cooling holes in communication with the two peripheral channels to supply cooling air to the pocket.

15. The squealer tip of claim 12, and further comprising:

a plurality of pocket exit cooling holes in communication with the two peripheral channels to supply cooling air to the pocket.

16. The squealer tip of claim 12, and further comprising:

the two peripheral channels each extend from a leading edge region to a trailing edge region of the squealer tip.

* * * * *